US012655505B2

(12) United States Patent
Yamashita et al.

(10) Patent No.: US 12,655,505 B2
(45) Date of Patent: Jun. 16, 2026

(54) MECHANICAL STRUCTURE STEEL FOR COLD-WORKING AND MANUFACTURING METHOD THEREFOR

(71) Applicant: Kabushiki Kaisha Kobe Seiko Sho, Kobe (JP)

(72) Inventors: Koji Yamashita, Kobe (JP); Shogo Murakami, Kobe (JP); Masayuki Sakata, Kobe (JP); Masamichi Chiba, Kobe (JP)

(73) Assignee: Kobe Steel, Ltd., Kobe (JP)

( * ) Notice: Subject to any disclaimer, the term of this patent is extended or adjusted under 35 U.S.C. 154(b) by 826 days.

(21) Appl. No.: 17/426,412

(22) PCT Filed: Jan. 14, 2020

(86) PCT No.: PCT/JP2020/000840
§ 371 (c)(1),
(2) Date: Jul. 28, 2021

(87) PCT Pub. No.: WO2020/158368
PCT Pub. Date: Aug. 6, 2020

(65) Prior Publication Data

US 2022/0106670 A1 Apr. 7, 2022

(30) Foreign Application Priority Data

Jan. 31, 2019 (JP) ..... 2019-016219
Nov. 22, 2019 (JP) ..... 2019-211181

(51) Int. Cl.

| | |
|---|---|
| ***C22C 38/02*** | (2006.01) |
| ***C21D 8/06*** | (2006.01) |
| ***C22C 38/00*** | (2006.01) |
| ***C22C 38/04*** | (2006.01) |
| ***C22C 38/06*** | (2006.01) |
| ***C22C 38/22*** | (2006.01) |
| ***C22C 38/42*** | (2006.01) |
| ***C22C 38/46*** | (2006.01) |
| ***C22C 38/48*** | (2006.01) |
| ***C22C 38/50*** | (2006.01) |

(52) U.S. Cl.
CPC ..... *C22C 38/22* (2013.01); *C21D 8/06* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C22C 38/46* (2013.01); *C22C 38/48* (2013.01); *C22C 38/50* (2013.01); *C21D 2211/005* (2013.01); *C21D 2211/009* (2013.01)

(58) Field of Classification Search
CPC ..... C22C 38/04
See application file for complete search history.

(56) References Cited

U.S. PATENT DOCUMENTS

| | | | | |
|---|---|---|---|---|
| 9,914,990 | B2 * | 3/2018 | Yamashita | C21D 1/32 |
| 2015/0041029 | A1 * | 2/2015 | Yamashita | C22C 38/24 420/104 |
| 2024/0150861 | A1 * | 5/2024 | Yamashita | C22C 38/001 |

FOREIGN PATENT DOCUMENTS

| | | | | |
|---|---|---|---|---|
| CN | 1799717 | A | 7/2006 | |
| CN | 102676929 | A | 9/2012 | |
| CN | 102716902 | A | 10/2012 | |
| JP | 2000-119809 | A | 4/2000 | |
| JP | 3737323 | B2 | 1/2006 | |
| JP | 3783666 | B2 | 6/2006 | |
| JP | 2006291237 | A * | 10/2006 | |
| JP | 2013-227602 | A | 11/2013 | |
| WO | WO-2013161538 | A1 * | 10/2013 | C21D 1/00 |

OTHER PUBLICATIONS

English machine translation of JP 2006-291237 A of Momosaki (Year: 2006).*
English translation of International Preliminary Report on Patentability and Written Opinion issued Aug. 12, 2021 in PCT/JP2020/000840, 7 pages.
Ruan Shipeng et al., "Effect of Control-Rolling-Cooling Process on Structure and Properties of Steel SCM435 Rod Coil", Special Steel, vol. 37. No. 5, Oct. 2016 • 45 •, pp. 45-47 (with English abstract).
International Search Report issued Apr. 7, 2020 in PCT/JP2020/000840 filed Jan. 14, 2020, 2 pages.
Zhang Hua-xing et al., "Research about Post-Rolling Controlled Cooling of Wire Bar of SCM435 Cold Heading Steel", Hebei Metallurgy, Total 161, 2007, No. 5, pp. 16-17 (with English abstract).
Xu Dong et al., "Continuous Cooling Transformation Behavior of Subcooling Austenite of SCM435 Steels", Journal of Northeastern University (Natural Science), vol. 34, No. 3, Mar. 2013, pp. 356-359 and 367 (with English abstract).
Zhao Xian-ping et al., "Discussion on spheroidizing annealing technology of SCM435 cold heading steel wire rod", Metal Products, vol. 35, No. 4, Aug. 2009, doi:10.3969/j. issn.1003-4226.2009.04.013, pp. 40-43 (with English abstract).
"Low-alloyed steels for cold heading", Japanese Industrial Standard (JIS) G3509-1: 2010, "Low-allowed steels for cold heading—Part 2:Wires" JIS G3509-2: 2003, 1534-1577 pages total.

(Continued)

*Primary Examiner* — Jophy S. Koshy
(74) *Attorney, Agent, or Firm* — Oblon, McClelland, Maier & Neustadt, L.L.P.

(57) ABSTRACT

Disclosed is a mechanical structure steel for cold-working, including: C: 0.32 to 0.44% by mass, Si: 0.15 to 0.35% by mass, Mn: 0.55 to 0.95% by mass, P: 0.030% by mass or less, S: 0.030% by mass or less, Cr: 0.85 to 1.25% by mass, Mo: 0.15 to 0.35% by mass, and Al: 0.01 to 0.1% by mass, with the balance consisting of iron and inevitable impurities, wherein an area ratio of proeutectoid ferrite is 30% or more and 70% or less, and an average grain size of ferrite crystal grains is 5 to 15 μm.

9 Claims, No Drawings

(56) References Cited

OTHER PUBLICATIONS

Wang Shifang et al. "Continuous Cooling Transformation Curve and Isothermal Transformation Curve of SCM435 Steel" Proceedings of the 23rd Annual Meeting of the National Metal Product Information Network and the 2013 Metal Product Industry Technology Information Exchange Meeting, Oct. 2013, pp. 295-300 (partial English translation).
"Conversion Table of Hardness", (SAE J 417), Revised in 1983, 1 page (partial English translation).
Shen Chengjin et al., Materials Heat Treatment and Surface Engineering, China University of Mining and Technology Press, 1st ed., Aug. 2011, p. 171 (partial English machine translation).

* cited by examiner

MECHANICAL STRUCTURE STEEL FOR COLD-WORKING AND MANUFACTURING METHOD THEREFOR

CROSS-REFERENCE TO RELATED APPLICATIONS

This application is a National Phase entry under 35 U.S.C. § 371 of PCT Application PCT/JP2020/000840, filed on Jul. 28, 2021, which claims the benefit of priority to Japanese Patent Application No. 2019-016219, filed on Jan. 31, 2019, and to Japanese Patent Application No. 2019-211181, filed on Nov. 22, 2019, the entire contents of each of which are incorporated herein by reference.

TECHNICAL FIELD

The present disclosure relates to a mechanical structure steel for cold-working and a manufacturing method therefor.

BACKGROUND ART

When producing various components, such as automobile components and construction machine components, spheroidizing annealing is normally applied to hot-rolled materials made of carbon steel, alloy steel or the like to impart adequate cold workability to the materials. The rolled materials obtained after the spheroidizing annealing are subjected to cold-working and then machining such as cutting, thus forming into a predetermined shape, followed by a quenching and tempering treatment to thereby finally adjust its strength.

In recent years, the conditions for spheroidizing annealing have been modified from the viewpoint of energy saving, and particularly, shortening of the spheroidizing annealing time has been required. For example, if the spheroidizing annealing time can be reduced by 20 to 30 percent, the reduction in energy consumption and $CO_2$ emission can be expected.

However, it is known that when the spheroidizing annealing is applied with a shorter time than usual (hereinafter referred to as "short-time annealing"), the spheroidization degree as an index of spheroidization of cementite becomes inferior and thus it is difficult to sufficiently soften the steel, leading to deterioration of the cold workability. Therefore, it is not easy to shorten the spheroidizing annealing time. Therefore, technology to sufficiently soften the steel without causing deterioration of the spheroidization degree, even when the short-time annealing is applied, is under consideration.

Patent Document 1 discloses, for example, a mechanical structure steel having excellent cold forgeability after spheroidizing annealing, comprising, in mass ratio, C: 0.3 to 0.6%, Mn: 0.2 to 1.5%, Si: 0.05 to 2.0%, Cr: 0.04 to 2.0%, with the balance consisting of iron and inevitable impurities, wherein, in a microstructure, an average grain size of prior austenite is 100 μm or more, and a ferrite fraction is 20% or less. The patent document discloses that this mechanical structure steel can sufficiently ensure the cold forgeability even by applying spheroidizing annealing for a relatively short time.

PRIOR ART DOCUMENT

Patent Document

Patent Document 1: JP 3783666 B1

DISCLOSURE OF THE INVENTION

Problems to be Solved by the Invention

However, the mechanical structure steel disclosed in Patent Document 1 includes Cr, but not Mo as an essential component. Whereas the strength of the steel can be significantly increased by including both Cr and Mo, such an increase in strength cannot be expected in the steel of Patent Document 1. Furthermore, the steel including both Cr and Mo may not be easily softened after spheroidizing annealing, but Patent Document 1 does not disclose that the steel including both Cr and Mo is sufficiently softened when the short-time annealing is applied thereto.

Embodiments of the present invention have been made under such circumstances and have an object to provide a mechanical structure steel for cold-working, which includes Cr and Mo, and is also excellent in spheroidization degree and can be sufficiently softened even when applying spheroidizing annealing for a relatively short time. Another object thereof is to provide a method for manufacturing a mechanical structure steel for cold-working, which includes Cr and Mo and can be sufficiently softened even when the time for the spheroidizing annealing is shortened.

Means for Solving the Problems

An aspect 1 of the present invention is directed to a mechanical structure steel for cold-working, comprising:

C: 0.32 to 0.44% by mass,
Si: 0.15 to 0.35% by mass,
Mn: 0.55 to 0.95% by mass,
P: 0.030% by mass or less,
S: 0.030% by mass or less,
Cr: 0.85 to 1.25% by mass,
Mo: 0.15 to 0.35% by mass, and
Al: 0.01 to 0.1% by mass, with the balance consisting of iron and inevitable impurities, wherein
an area ratio of proeutectoid ferrite is 30% or more and 70% or less, and
an average grain size of ferrite crystal grains is 5 to 15 μm.

An aspect 2 of the present invention is directed to the mechanical structure steel for cold-working according to the aspect 1, wherein a ratio of an area ratio of pearlite to the total area ratio of microstructures other than the proeutectoid ferrite is 80% or less.

An aspect 3 of the present invention is directed to the mechanical structure steel for cold-working according to the aspect 1 or 2, wherein the hardness is HV300 or less.

An aspect 4 of the present invention is directed to the mechanical structure steel for cold-working according to any one of the aspects 1 to 3, further comprising at least one of:

Cu: 0.25% by mass or less (excluding 0% by mass), and
Ni: 0.25% by mass or less (excluding 0% by mass).

An aspect 5 of the present invention is directed to the mechanical structure steel for cold-working according to any one of the aspects 1 to 4, further comprising at least one of:

Ti: 0.2% by mass or less (excluding 0% by mass),
Nb: 0.2% by mass or less (excluding 0% by mass), and
V: 1.5% by mass or less (excluding 0% by mass).

An aspect 6 of the present invention is directed to the mechanical structure steel for cold-working according to any one of the aspects 1 to 5, further comprising at least one of:

N: 0.01% by mass or less (excluding 0% by mass),
Mg: 0.02% by mass or less (excluding 0% by mass),
Ca: 0.05% by mass or less (excluding 0% by mass), Li: 0.02% by mass or less (excluding 0% by mass), and REM: 0.05% by mass or less (excluding 0% by mass).

An aspect 7 of the present invention is directed to a method for manufacturing a mechanical structure steel for cold-working, the method comprising:

preparing a steel having a chemical composition according to any one of the aspects 1 to 5, followed by being subjected to the steps of:

(a) performing pre-working at a compression ratio of 20% or more and a holding time of 10 seconds or less, (b) after the step (a), performing finishing at higher than 800° C. and 1,050° C. or lower and a compression ratio of 20% or more, (c) after the step (b), cooling to 750° C. or higher and 840° C. or lower over 10 seconds or less, and (d) after the step (c), cooling to 500° C. or lower at an average cooling rate of 0.1° C./sec or more and less than 10° C./sec.

An aspect 8 of the present invention is directed to a method for manufacturing a steel wire, the method comprising subjecting the mechanical structure steel for cold-working manufactured by the method according to the aspect 7 to one or more steps of annealing, spheroidizing annealing, wire drawing, heading and quenching/tempering.

Effects of the Invention

In one embodiment of the present invention, it is possible to provide a mechanical structure steel for cold-working, which includes Cr and Mo, and is also excellent in spheroidization degree and can be sufficiently softened even when the spheroidizing annealing time is shorter than usual. In another one embodiment of the present invention, it is possible to provide a method for manufacturing a mechanical structure steel for cold-working, which includes Cr and Mo and can be sufficiently softened even when the time for the spheroidizing annealing is shortened.

Mode for Carrying Out the Invention

The inventors of the present application have studied from various angles in order to realize a mechanical structure steel for cold-working, which includes Cr and Mo, and is also excellent in spheroidization degree and can be sufficiently softened even when the spheroidizing annealing time is made shorter than usual.

As a result, they have found that, by appropriately adjusting the chemical composition including Cr and Mo, including proeutectoid ferrite, and controlling the area ratio of the proeutectoid ferrite and the average grain size of ferrite crystal grains to the predetermined values, it is possible to realize a mechanical structure steel for cold-working, which is excellent in spheroidization degree and can be sufficiently softened even when the spheroidizing annealing time is shortened.

Further, they have simultaneously found that, by controlling the area ratio of the proeutectoid ferrite and the average grain size of ferrite crystal grains, it is possible to realize a mechanical structure steel for cold-working, which can be sufficiently softened even when the temperature during spheroidizing annealing varies. This is very beneficial when the spheroidizing annealing is performed in a large furnace. In other words, although the temperature in the large furnace varies considerably due to the existence of places where the temperature is lower than the set temperature and/or where the temperature rise rate is low, the mechanical structure steel for cold-working of the present invention can be sufficiently softened even when the spheroidizing annealing is applied in such a furnace.

Details of the respective requirements specified by the embodiments of the present invention will be illustrated below.

Note that the term "wire rod" as used herein means a rolled wire rod, specifically, indicating a wire-like steel material produced by cooling a hot-rolled steel to room temperature. Further, the term "steel wire" as used herein indicates a wire-like steel material having its properties adjusted by annealing the above-mentioned rolled wire rod.

<1. Chemical Composition>

The mechanical structure steel for cold-working according to the embodiment of the present invention includes: C: 0.32 to 0.44% by mass, Si: 0.15 to 0.35% by mass, Mn: 0.55 to 0.95% by mass, P: 0.030% by mass or less, S: 0.030% by mass or less, Cr: 0.85 to 1.25% by mass, Mo: 0.15 to 0.35% by mass, and Al: 0.01 to 0.1% by mass, with the balance consisting of iron and inevitable impurities.

The respective elements will be described in detail below.

(C: 0.32 to 0.44% by Mass)

C is a strength imparting element, and if the content thereof is less than 0.32% by mass, the strength required for the final product cannot be obtained. Meanwhile, if the content exceeds 0.44% by mass, the cold workability and toughness of the steel deteriorate. Therefore, the C content is set in a range of 0.32 to 0.44% by mass. The C content is preferably set at less than 0.40% by mass since the proeutectoid ferrite can be precipitated in a larger amount.

(Si: 0.15 to 0.35% by Mass)

Si is useful as a deoxidizing element and as an improving element to be included for the purpose of increasing the strength of the final product by solid-solution hardening. To effectively exert these effects, the Si content is set at 0.15% by mass or more. Meanwhile, an excessive Si content extremely raises the hardness of the steel, leading to deterioration of the cold workability. Therefore, the Si content is set at 0.35% by mass or less.

(Mn: 0.55 to 0.95% by Mass)

Mn is an effective element in increasing the strength of the final product through an improvement in hardenability. To effectively exert these effects, the Mn content is set at 0.55% by mass or more. Meanwhile, an excessive Mn content raises the hardness of the steel, leading to deterioration of the cold workability. Therefore, the Mn content is set at 0.95% by mass or less.

(P: 0.030% by Mass or Less)

P is an element inevitably included in the steel and causes grain boundary segregation in the steel, leading to deterioration of the ductility of the steel. Therefore, the P content is set at 0.030% by mass or less.

(S: 0.030% by Mass or Less)

S is an element inevitably included in the steel, and is a harmful element that causes deterioration of the cold workability of the steel since S is present in the form of MnS in the steel to cause deterioration of the ductility of the steel. Therefore, the S content is set at 0.030% by mass or less.

(Cr: 0.85% by Mass or More and 1.25% by Mass or Less)

Cr is an effective element in increasing the strength of the final product through an improvement in hardenability of the steel material. To effectively exert these effects, the Cr content is set at 0.85% by mass or more. These effects become higher as the Cr content increases. However, an excessive Cr content extremely raises the strength of the steel, leading to deterioration of the cold workability. Therefore, the Cr content is set at 1.25% by mass or less.

(Mo: 0.15% by Mass or More and 0.35% by Mass or Less)

Mo is an effective element in increasing the strength of the final product through an improvement in hardenability of the steel material. In particular, by including Mo in the steel together with Cr, the strength of the final product can be significantly increased. To effectively exert these effects, the Mo content is set at 0.15% by mass or more. These effects become higher as the Mo content increases. However, an excessive Mo content extremely raises the strength of the steel, leading to deterioration of the cold workability. In particular, by including Mo in the steel together with Cr, it becomes difficult for the steel to be significantly softened after spheroidizing annealing. Therefore, the Mo content is set at 0.35% by mass or less.

(Al: 0.01% by Mass or More and 0.1% by Mass or Less)

Al is useful as a deoxidizing element, and is an element that prevents the strength from decreasing due to abnormal growth of crystal grains during working as a result of combining with N to precipitate AlN. To efficiently exert these effects, the Al content is set at 0.01% by mass or more. The Al content is preferably 0.015% by mass or more, and more preferably 0.020% by mass or more. However, an excessive Al content causes excessive formation of $Al_2O_3$, leading to deterioration of the cold workability. Therefore, the Al content is set at 0.1% by mass or less. The Al content is preferably 0.090% by mass or less, and more preferably 0.080% by mass or less.

The balance is iron and inevitable impurities. Mixing of inevitable impurities, such as elements (e.g., B, As, Sn, Sb, Ca, O, H, etc.) due to the conditions of raw materials, materials, manufacturing facilities and the like is allowed.

For example, there are some elements such as P and S, which are usually preferable in smaller contents, and are therefore inevitable impurities, and their composition ranges are specified separately as mentioned above. Therefore, the term "inevitable impurities" constituting the balance as used herein means the concept excluding elements whose composition ranges are separately specified.

The mechanical structure steel for cold-working according to the embodiment of the present invention may selectively include arbitrary elements as appropriate, and the properties of the steel can be further improved depending on the type of selected components.

(One or More Elements Selected from the Group Consisting of Cu: 0.25% by Mass or Less (Excluding 0% by Mass) and Ni: 0.25% by Mass or Less (Excluding 0% by Mass))

Cu and Ni are effective element in improving the hardenability and increasing the strength of the final product. These effects become higher as the contents of these elements increase. To effectively exert these effects, each content of Cu and Ni is preferably 0.05% by mass or more, more preferably 0.08% by mass or more, and still more preferably 0.10% by mass or more. However, an excessive content causes excessive formation of supercooled microstructures and extremely raises the strength of the steel, leading to deterioration of the cold forgeability. Therefore, each content of Cu and Ni is preferably set at 0.25% by mass or less. The content is more preferably 0.22% by mass or less, and still more preferably 0.20% by mass or less. Note that Cu and Ni may be included alone or two or more elements thereof may be included, and when two or more elements thereof are included, each content may be arbitrary content within the above range.

(One or More Elements Selected from the Group Consisting of Ti: 0.2% by Mass or Less (Excluding 0% by Mass), Nb: 0.2% by Mass or Less (Excluding 0% by Mass) and V: 1.5% by Mass or Less (Excluding 0% by Mass))

Ti, Nb, and V are elements that combine with N to form a compound (nitride) and reduce the amount of solid-solution N in the steel, thus obtaining the deformation resistance reduction effect. To exert these effects, each content of Ti, Nb and V is preferably 0.05% by mass or more, more preferably 0.06% by mass or more, and still more preferably 0.08% by mass or more. However, an excessive content raises the amount of nitride and the deformation resistance, leading to deterioration of the cold forgeability. Therefore, each content of Ti and Nb is preferably 0.2% by mass or less, more preferably 0.18% by mass or less, and still more preferably 0.15% by mass or less. The content of V is preferably 1.5% by mass or less, more preferably 1.3% by mass or less, and still more preferably 1.0% by mass or less. Note that Ti, Nb, and V may be included alone or two or more elements thereof may be included, and when two or more elements thereof are included, each content may be arbitrary content within the above range.

(One or More Elements Selected from the Group Consisting of N: 0.01% by Mass or Less (Excluding 0% by Mass), Mg: 0.02% by Mass or Less (Excluding 0% by Mass), Ca: 0.05% by Mass or Less (Excluding 0% by Mass), Li: 0.02% by Mass (Excluding 0% by Mass) and Rare Earth Element (REM): 0.05% by Mass or Less (Excluding 0% by Mass))

N is an element inevitably included in the steel. If the solid-solution N is included in the steel, the hardness of the steel is raised due to strain aging, and the ductility thereof is degraded, leading to deterioration of the cold workability. Therefore, the N content is preferably 0.01% by mass or less, more preferably 0.009% by mass or less, and still more preferably 0.008% by mass or less. Mg, Ca, Li and REM are effective elements in spheroidizing sulfide compound-based inclusions such as MnS and improving the deformability of the steel. These effects become higher as the contents of these elements increase. To exert these effects, each content of Mg, Ca, Li and REM is preferably 0.0001% by mass or more, and more preferably 0.0005% by mass or more. However, even if these elements are excessively included, these effects are saturated and the effects commensurate with the contents cannot be expected. Therefore, each content of Mg and Li is preferably 0.02% by mass or less, more preferably 0.018% by mass or less, and still more preferably 0.015% by mass or less. Each content of Ca and REM is preferably 0.05% by mass or less, more preferably 0.045% by mass or less, and still more preferably 0.040% by mass or less. Note that N, Ca, Mg, Li and REM may be included alone or two or more elements thereof may be included, and when two or more elements thereof are included, each content may be arbitrary content within the above range.

<2. Microstructures>

The mechanical structure steel for cold-working according to the embodiment of the present invention includes proeutectoid ferrite. The proeutectoid ferrite contributes to softening of the steel after spheroidizing annealing. However, when especially including Cr and Mo, simply including the proeutectoid ferrite is not enough to realize a steel which is excellent in spheroidization degree and can be sufficiently softened after short-time annealing.

Therefore, as will be described in detail below, the mechanical structure steel for cold-working according to the embodiment of the present invention is controlled so that an area ratio of proeutectoid ferrite is 30% or more and 70% or less, and an average grain size of ferrite crystal grains is 5 to 15 μm.

[2-1. Area Ratio of Proeutectoid Ferrite: 30% or More and 70% or Less]

The presence of a large amount of proeutectoid ferrite enables acceleration of agglomeration and spheroidization of carbides such as cementite during spheroidizing annealing, resulting in an improvement in spheroidization degree and a reduction in hardness of the steel. From such a viewpoint, there is a need to set the area ratio of the proeutectoid ferrite at 30% or more. The area ratio of the proeutectoid ferrite is preferably more than 30%, more preferably more than 35%, and still more preferably more than 40%. Meanwhile, when trying to make a large amount of the proeutectoid ferrite present, the manufacturing time increases. Considering the practical manufacturing time, there is a need to keep the area ratio of the proeutectoid ferrite 70% or less.

[2-2. Average Grain Size of Ferrite Crystal Grains: 5 to 15 μm]

The reduction in average grain size of ferrite crystal grains enables acceleration of agglomeration and spheroidization of carbides such as cementite after spheroidizing annealing, resulting in an improvement in spheroidization degree and a reduction in hardness of the steel. From such a viewpoint, there is a need to control the average grain size of ferrite crystal grains to 15 μm or less. The average grain size is preferably 13 μm or less. Meanwhile, there is a need to control the grain size to 5 μm or more since excessive refining of crystal grains leads to an increase in hardness. The grain size is preferably controlled to 7 μm or more.

Note that the term "ferrite crystal grains" as used herein refer to the ferrite region surrounded by grain boundaries, wherein the grain boundaries are boundaries which have a crystallographic orientation difference (oblique angle) exceeding 15° (also referred to as high angle grain boundaries) as a result of electron backscattering pattern (EBSP) analysis. Note that the term "average grain size" as used herein refers to the average value of the diameter when the area of the region surrounded by the grain boundaries is converted into a circle, i.e., an average circle equivalent diameter.

The average grain size of ferrite crystal grains is measured using, for example, a field emission scanning electron microscope (FE-SEM) and an EBSP analyzer.

The mechanical structure steel for cold-working according to the embodiment of the present invention may have the following microstructures as appropriate, and thus the properties of the steel after spheroidizing annealing can be further improved.

[2-3. Ratio of Area Ratio of Pearlite to the Total Area Ratio of Microstructures Other than Proeutectoid Ferrite: 80% or Less]

From the viewpoint of improving the spheroidization degree of the steel after spheroidizing annealing, it is effective to reduce the ratio of pearlite in microstructures other than proeutectoid ferrite (hereinafter sometimes referred to as "balance microstructures"). If the ratio of pearlite in the balance microstructures is too large, rod-shaped carbides are likely to exist even after spheroidizing annealing, leading to deterioration of the spheroidization degree of the steel. The ratio of the area ratio of pearlite to the total area ratio of microstructures other than proeutectoid ferrite is preferably 80% or less, and more preferably 70% or less.

Examples of microstructures other than pearlite in the balance microstructures include bainite, martensite, austenite and the like. It is more preferable that the microstructure is entirely bainite in order to improve the spheroidization degree of the steel. Specifically, when the ratio of the area ratio of pearlite in the balance microstructures is 80% or less, it is more preferable that the area ratio of bainite in the balance microstructures is 20% or more, and when the ratio of the area ratio of pearlite in the balance microstructures is 70% or less, it is more preferable that the ratio of the area ratio of bainite in the balance microstructures is 30% or more.

<3. Hardness>

The mechanical structure steel for cold-working according to the embodiment of the present invention may have the following hardness as appropriate, and thus the properties of the steel after spheroidizing annealing can be further improved.

[3. Hardness of 300 HV or Less]

To soften the steel after spheroidizing annealing, it is effective to reduce the hardness of the steel in advance. For this purpose, the hardness of the steel is set at HV350 or less, and preferably HV300 or less. The hardness is more preferably HV290 or less.

<4. Manufacturing Method>

In the method for manufacturing a mechanical structure steel for cold-workings according to the embodiment of the present invention, a steel material satisfying the chemical composition mentioned above is used, and working and cooling after working are performed. Working and cooling after working are performed in two stages, respectively.

Specifically, in the method for manufacturing a mechanical structure steel for cold-workings according to the embodiment of the present invention, a steel having the chemical composition mentioned above is prepared and then subjected to the following steps of:

(a) performing pre-working at a compression ratio of 20% or more and a holding time of 10 seconds or less,
(b) after the step (a), performing finishing at higher than 800° C. and 1,050° C. or lower and a compression ratio of 20% or more,
(c) after the step (b), cooling to 750° C. or higher and 840° C. or lower over 10 seconds or less, and
(d) after the step (c), cooling to 500° C. or lower at an average cooling rate of 0.1° C./sec or more and less than 10° C./sec.

Each step will be described in detail below. Note that the term "working" as used herein may be arbitrary working as long as it satisfies the requirements mentioned above, and may include, for example, pressing and rolling. The steps (c) and (d) are sometimes referred to as the first cooling and the second cooling, respectively.

[Step (a): Performing Pre-Working at Compression Ratio of 20% or More and Holding Time of 10 Seconds or Less]

To increase the ratio of proeutectoid ferrite and to refine ferrite crystal grains, pre-working is performed at a compression ratio of 20% or more. The compression ratio is preferably 30% or more. The compression ratio is calculated as follows.

<Compression Ratio when Pressing is Applied (in this Case, the Compression Ratio is Also Referred to as Draft)>

$$\text{Compression ratio } (\%)=(h1-h2)/h1\times 100$$

where h1 height of steel before working, h2: height of steel after working

<Compression ratio when wire rod is obtained by rolling (in this case, compression ratio is also referred to as area reduction ratio)>

$$\text{Compression ratio } (\%)=(S1-S2)/S1\times 100$$

S1: cross-sectional area of steel before working, h2: cross-sectional area of steel after working It is preferable that the temperature during pre-working is relatively low in order to increase the ratio of proeutectoid ferrite and to refine ferrite crystal grains.

There is a need to relatively shorten the holding time from pre-working to finishing in order to suppress the growth of ferrite crystal grains. Therefore, the holding time is set at 10 seconds or less, and preferably 5 seconds or less.

[Step (b): After the Step (a), Performing Finishing at Higher than 800° C. And 1,050° C. Or Lower and Compression Ratio of 20% or More]

To increase the ratio of proeutectoid ferrite and to refine ferrite crystal grains, finishing is performed at a compression ratio of 20% or more. The compression ratio is preferably 50% or more. The working temperature is set at higher than 800° C. and 1,050° C. or lower in order to control the average grain size of ferrite crystal grains in a range of 5 to 15 μm. The working temperature is preferably 1,000° C. or lower, and more preferably 950° C. or lower, for the purpose of refining ferrite crystal grains. Meanwhile, the working temperature is preferably 825° C. or higher, and more preferably 850° C. or higher, in order to prevent excessive refining of ferrite crystal grains.

[First Cooling: Step (c): After the Step (b), Cooling to 750° C. Or Higher and 840° C. Or Lower Over 10 Seconds or Less]

To increase the ratio of the proeutectoid ferrite and to refine ferrite crystal grains, cooling is performed to a predetermined temperature (hereinafter also referred to as first cooling stop temperature) immediately after the finishing. The time of cooling from the finishing temperature to the first cooling stop temperature is set at 10 seconds or less. The cooling time is preferably set at 5 seconds or less, and more preferably 3 seconds or less.

To increase the ratio of the proeutectoid ferrite and to control the average grain size of ferrite crystal grains to 5 to 15 μm, the first cooling stop temperature is set at 750° C. or higher and 840° C. or lower. To increase the ratio of the proeutectoid ferrite, the temperature is preferably 775° C. or higher. Meanwhile, if the temperature is too high, the average grain size of ferrite crystal grains easily become larger, and therefore the temperature is preferably 820° C. or lower.

[Second Cooling: Step (d): After the Step (c), Cooling to 500° C. Or Lower at Average Cooling Rate of 0.1° C./Sec or More and Less than 10° C./Sec]

To increase the ratio of proeutectoid ferrite and to refine ferrite crystal grains, and to reduce the ratio of pearlite in the balance microstructures and the hardness, cooling is performed from the first cooling stop temperature to 500° C. or lower at an average cooling rate of 0.1° C./sec or more to less than 10° C./sec. The average cooling rate is preferably 1 to 3° C./sec.

After the step (d), the cooling method in the temperature range of 500° C. or lower is not particularly limited. For example, the cooling may be a natural cooling, or if the average cooling rate of the second cooling is relatively slow, e.g., less than 1° C./sec, gas rapid cooling may be used to shorten the time.

As mentioned above, it is possible to obtain a mechanical structure steel for cold-working according to the embodiment of the present invention. It is assumed that spheroidizing annealing is applied to the steel then, but in some cases, other working (such as wire drawing) may be applied to the steel before or after spheroidizing annealing.

The mechanical structure steel for cold-working according to the embodiment of the present invention is excellent in spheroidization degree and can be sufficiently softened even when subjected to spheroidizing annealing with a relatively short time (e.g., spheroidizing annealing with the time shortened to about 11 hours as usual compared with about 15 hours) then. In the embodiment of the present invention, it is possible to manufacture a steel wire by subjecting the steel obtained under the above manufacturing conditions to one or more steps of annealing, spheroidizing annealing, wire drawing, heading, and quenching/tempering. The term "steel wire" as used herein refers to a wire-like steel material having properties adjusted by subjecting the steel obtained under the above manufacturing conditions to annealing, spheroidizing annealing, drawing, heading, quenching/tempering and the like, but also includes a steel material which has undergone steps generally performed by secondary working manufacturers, in addition to the above steps such as annealing.

As mentioned above, while the method for manufacturing a mechanical structure steel for cold-working according to the embodiment of the present invention has been described above, a person skilled in the art who understands desired properties of the mechanical structure steel for cold-working according to the embodiment of the present invention may take a process of trial and error to find a method of manufacturing a mechanical structure steel for cold-working according to the embodiment of the present invention with the desired properties according to the embodiment of the present invention, other than the manufacturing method mentioned above.

EXAMPLES

Examples of the present invention will be more specifically described by way of Examples. The embodiments of the present invention are not limited by the following Examples, and it is possible to implement the embodiments with modifications within the range that can meet the gist of the present disclosure as described above and below, all of these modifications being within the scope of the present disclosure.

Example 1

Using steels having the chemical compositions indicated by steel types A and D shown in Table 1, test specimens for working Formastor, each having a size of ϕ10 mm×15 mm, were fabricated. The thus obtained test specimens for the working Formastor were subjected to pressing and cooling performed by a working Formastor tester under the conditions shown in Table 2. Although not shown in Table 2, cooling in the temperature range of 500° C. or lower was performed at an average cooling rate during the second cooling to near room temperature (25° C. to 40° C.) when the average cooling rate during the second cooling was 1° C./second or higher, while gas rapid cooling was performed when the average cooling rate during the second cooling was less than 1° C./second.

In Tables 1 and 2, and Tables 3 to 5 shown below, underlined numerical values indicate that the results are outside the embodiment of the present invention. The value calculated by the following equation (1) was shown in the carbon equivalent column in Table 1.

$$\text{Carbon equivalent (Ceq)}=[C]+[Si]/24+[Mn]/6+[Ni]/40+[Cr]/5+[Mo]/4+[V]/14 \quad (1)$$

where [C], [Si], [Mn], [Ni], [Cr], [Mo] and [V] are the contents, in % by mass, of C, Si, Mn, Ni, Cr, Mo and V, respectively.

TABLE 1

| Steel type | Chemical composition (% by mass) ※ The balance being iron and inevitable impurities | | | | | | | | Carbon equivalent |
|---|---|---|---|---|---|---|---|---|---|
| | C | Si | Mn | P | S | Cr | Mo | Al | |
| A | 0.35 | 0.18 | 0.70 | 0.018 | 0.013 | 0.96 | 0.16 | 0.028 | 0.71 |
| B | 0.35 | 0.19 | 0.67 | 0.010 | 0.006 | 0.95 | 0.17 | 0.036 | 0.70 |
| C | 0.35 | 0.19 | 0.75 | 0.010 | 0.003 | 0.98 | 0.17 | 0.033 | 0.72 |
| D | 0.40 | 0.20 | 0.70 | 0.013 | 0.006 | 0.98 | 0.16 | 0.025 | 0.76 |

TABLE 2

| Test No. | Steel type | Working: Pre-working: Temperature (° C.) | Working: Pre-working: Compression ratio (%) | Working: Pre-working: Holding time (sec) | Working: Finishing: Temperature (° C.) | Working: Finishing: Compression ratio (%) | Cooling: First cooling: Average cooling rate (° C./sec) | Cooling: First cooling: Cooling stop temperature (° C.) | Cooling: First cooling: Cooling time (sec) | Cooling: Second cooling: Average cooling rate of cooling stop temperature to 500° C. (° C./sec) |
|---|---|---|---|---|---|---|---|---|---|---|
| 1-1 | A | 900 | 42 | 5 | 900 | 57 | 50 | 750 | 3 | 1 |
| 1-2 | A | 900 | 42 | 5 | 900 | 57 | 50 | 750 | 3 | 3 |
| 1-3 | A | 1,000 | 42 | 5 | 1,000 | 57 | 50 | 750 | 5 | 0.1 |
| 1-4 | A | 900 | 42 | 5 | 900 | 57 | 50 | 750 | 3 | 0.1 |
| 1-5 | A | 1,200 | 42 | 5 | 1,200 | 57 | 50 | 750 | 9 | 0.1 |
| 1-6 | A | 800 | 42 | 5 | 800 | 57 | 50 | 750 | 1 | 1 |
| 1-7 | A | 900 | 42 | 5 | 900 | 57 | 50 | 750 | 3 | 10 |
| 1-8 | A | 1,200 | 42 | 5 | 1,200 | 57 | 50 | 750 | 9 | 3 |
| 1-9 | D | 900 | 42 | 5 | 900 | 57 | 50 | 750 | 3 | 1 |
| 1-10 | D | 850 | 42 | 5 | 850 | 57 | 50 | 750 | 2 | 0.5 |

Each of the test specimens subjected to a working heat treatment was cut into four equal pieces along its central axis to obtain four samples including longitudinal sections. One of these samples was not subjected to spheroidizing annealing (hereinafter sometimes referred to as sample before spheroidizing annealing), and another one was subjected to spheroidizing annealing (hereinafter sometimes referred to as sample after spheroidizing annealing). The spheroidizing annealing was performed by placing each test specimen in a vacuum sealed tube.

The spheroidizing annealing was performed under the following two conditions (SA1 and SA2).

SA1: The test specimen was subjected to soaking by holding its temperature at 760° C. for 5 hours, then cooled to 685° C. at an average cooling rate of 13° C./hour, followed by naturally cooling.

SA2: The test specimen was subjected to soaking by holding its temperature at 750° C. for 2 hours, then cooled to 660° C. at an average cooling rate of 13° C./hour, followed by naturally cooling.

In SA1, the spheroidizing annealing time was reduced to about 11 hours, compared with about 15 hours in the conventional technique. Note that the term "spheroidizing annealing time" as used herein is the sum of the soaking holding time and the cooling time until the natural cooling. SA2 was performed at a lower temperature than SA1, assuming a delay in temperature tracking.

The samples before spheroidizing annealing were embedded in a resin so that the longitudinal section could be observed, and (1) the area ratio of proeutectoid ferrite, (2) the average grain size of ferrite grains, (3) the ratio of the area ratio of pearlite to the total area ratio of the microstructures other than proeutectoid ferrite, and (4) the hardness before spheroidizing annealing were measured.

For the samples after spheroidizing annealing, the longitudinal sections were embedded in a resin so that they could be observed in the same way as mentioned above, and (5) the hardness after spheroidizing annealing and (6) the spheroidization degree were measured.

In any of the measurements (1) to (6), the diameter of the specimen was set at D and the position of D/4 from the side of the test specimen toward the central axis was measured.

(1) Measurement of Area Ratio of Proeutectoid Ferrite

The longitudinal section of the sample before spheroidizing annealing was etched with nital to expose its microstructures. Then, photographs of the D/4 position were taken using an optical microscope at magnifications of 400 times (field of view: 220 μm in lateral direction×165 μm in longitudinal direction) and 1,000 times (field of view: 88 μm in lateral direction×66 μm in longitudinal direction). Then, on each of the images thus obtained, fifteen lines were drawn in longitudinal direction at equal intervals and ten lines were drawn in lateral direction at equal intervals in a grid pattern to form 150 intersection points. Among the 150 intersection points, the number of points where proeutectoid ferrite or pearlite exists was measured on each image. The value obtained by dividing the number of points by 150 was defined as the area ratio (%) of proeutectoid ferrite.

For the below-mentioned samples having an average grain size of ferrite crystal grains of 10 μm or more, the measurement was made using a photograph taken at a magnification of 400 times. For samples having an average grain size of less than 5 μm, the measurement was made using a photograph taken at a magnification of 1,000 times. For samples having an average grain size of 5 μm or more and less than 10 μm, the measurement was made by appropriately selecting a photograph taken at a magnification of 400 or 1,000 times.

(2) Measurement of Average Grain Size of Ferrite Crystal Grains

The average grain size of ferrite crystal grains was measured using FE-SEM and EBSP analyzer.

Backscattered electron diffraction images were obtained by FE-SEM at the D/4 position of the longitudinal section of the sample before spheroidizing annealing. In the images thus obtained, the average grain size of "crystal grains" in ferrite was determined by defining the grain boundaries, wherein the grain boundaries are boundaries which have a crystallographic orientation difference (oblique angle) exceeding 15°, i.e., large angle grain boundaries, by using the EBSP analyzer. In that case, the measurement area was 200 μm×200 μm, and the measurement steps were 0.4 μm apart. The measurement points with a Confidence Index, which indicates the reliability of the measurement orientation, of no more than 0.1 were deleted from the analysis.

(3) Measurement of Ratio of Area Ratio of Pearlite to Total Area Ratio of Microstructures other than the Proeutectoid Ferrite The longitudinal section of the sample before spheroidizing annealing was etched with vital to expose its microstructures. Then, photographs of the D/4 position were taken with an optical microscope at magnifications of 400 times (field of view: 220 μm in lateral direction×165 μm in longitudinal direction) and 1,000 times (field of view: 88 μm in lateral direction×66 μm in longitudinal direction). Then, on each of the images thus obtained, fifteen lines were drawn in longitudinal direction at equal intervals and ten lines were drawn in lateral direction at equal intervals in a grid pattern to form 150 intersection points. Among the 150 intersection points, the number of points A where proeutectoid ferrite or pearlite exists was measured on each image. Next, the number of points B of pearlite existing on the 150 intersection points was measured, and the value obtained by dividing the number of points B by the number of points (150−A) was defined as the ratio (%) of the area ratio of pearlite to the total area ratio of microstructures other than proeutectoid ferrite.

For the below-mentioned samples each having an average grain size of ferrite crystal grains of 10 μm or more, the measurement was made using a photograph taken at a magnification of 400 times. For samples each having an average grain size of less than 5 μm, the measurement was made using a photograph taken at a magnification of 1,000 times. For samples each having an average grain size of 5 μm or more and less than 10 μm, the measurement was made by appropriately selecting a photograph taken at a magnification of 400 or 1,000 times.

(4) Measurement of Hardness before Spheroidizing Annealing

For the longitudinal section of the sample before spheroidizing annealing, measurement was made at 3 to 5 points using a Vickers hardness tester at D/4 position under a load of 1 kgf, and the average value (HV) was determined.

(5) Measurement of Hardness after Spheroidizing Annealing

For the longitudinal section of the sample after spheroidizing annealing, measurement was made at 3 to 5 points using a Vickers hardness tester at D/4 position under a load of 1 kgf, and the average value (HV) was determined.

Since it is known that the hardness increases as the carbon equivalent of the steel type increases, the criterion for determining the hardness after spheroidizing annealing in this Example was set according to the carbon equivalent (Ceq) of the steel type. Specifically, the hardness after SA1 was determined based on whether or not the following expression (2) is satisfied.

$$(\text{Hardness (HV)})<97.3\times\text{Ceq}+84 \quad (2)$$

The case where the hardness after SA1 was rated Excellent (A) if it satisfies the above expression (2), while the hardness was rated Poor (C) if it does not satisfy the above expression (2).

When the carbon equivalent is 0.70 or more, it is more preferable if the hardness after SA1 is HV150 or less.

Since SA2 is an annealing condition in which softening is not easily achieved at lower temperature compared with SA1, a criterion (looser criterion) which is different from that in the above expression (2) was set for the hardness after SA2. Specifically, the hardness after SA2 was determined based on whether or not the following expression (3) was satisfied.

$$(\text{Hardness (HV)})<97.3\times\text{Ceq}+98 \quad (3)$$

The case where the hardness after SA2 was rated Excellent (A) if it satisfies the above expression (3), while the hardness was rated Poor (C) if it does not satisfy the above expression (3).

When the carbon equivalent is 0.70 or more, it is more preferable if the hardness after SA2 is HV165 or less.

(6) Measurement of Spheroidization Degree

The longitudinal section of the sample after spheroidizing annealing was etched with nital to expose its microstructures, and then the microstructures were observed at the D/4 position using an optical microscope at a magnification of 400 times (field of view: 220 μm in lateral direction×165 μm in longitudinal direction). The spheroidization degrees Nos. 1 to 3 were determined for the observed images according to the "spheroidization degree" mentioned in JIS G3509-2. The spheroidization degree No. 1 was rated as Excellent (A), the spheroidization degree No. 2 was rated Good (B), and the spheroidization degree No. 3 was rated Poor (C), respectively.

The microstructures and the hardness before spheroidizing annealing as well as the hardness and the spheroidization degree after spheroidizing annealing evaluated by the above procedures in (1) to (6) are shown in Table 3. Regarding the overall judgment after SA1, the case where both the hardness and spheroidization degree after SA1 were excellent was rated Excellent (A), the case where rating A and rating B coexist was rated Good (B), and the case where at least one rating C exists was rated Poor (C).

TABLE 3

| | | Before spheroidizing annealing | | | | After spheroidizing annealing | | | | | | | | | |
|---|---|---|---|---|---|---|---|---|---|---|---|---|---|---|---|
| | | | | | | After SA1 (high temperature) | | | | | | After SA2 (low temperature) | | | |
| Test No. | Steel type | Area ratio of proeutectoid ferrite (%) | Average grain size of ferrite crystal grains (μm) | Pearlite area ratio of balance micro-structures (%) | Hard-ness (HV) | Hard-ness (HV) | Right side of expression (2) | Judg-ment | Spheroidi-zation degree (No.) | Judg-ment | Overall judgment | Hard-ness (HV) | Right side of expression (3) | Judg-ment |
| 1-1 | A | 47 | 7.9 | 78 | 214 | 144 | 153 | A | 1 | A | A | 157 | 167 | A |
| 1-2 | A | 42 | 6.5 | 39 | 279 | 148 | 153 | A | 1 | A | A | 155 | 167 | A |

TABLE 3-continued

| | | Before spheroidizing annealing | | | | After spheroidizing annealing | | | | | | | | |
|---|---|---|---|---|---|---|---|---|---|---|---|---|---|---|
| | | | | | | After SA1 (high temperature) | | | | | | After SA2 (low temperature) | | |
| Test No. | Steel type | Area ratio of proeutectoid ferrite (%) | Average grain size of ferrite crystal grains (μm) | Pearlite area ratio of balance micro-structures (%) | Hard-ness (HV) | Hard-ness (HV) | Right side of expression (2) | Judg-ment | Spheroidi-zation degree (No.) | Judg-ment | Overall judgment | Hard-ness (HV) | Right side of expression (3) | Judg-ment |
| 1-3 | A | 49 | 13.2 | 100 | 221 | 145 | 153 | A | 2 | B | B | 148 | 167 | A |
| 1-4 | A | 55 | 8.1 | 100 | 199 | 148 | 153 | A | 2 | B | B | 150 | 167 | A |
| 1-5 | A | 47 | 26.6 | 100 | 194 | 145 | 153 | A | 3 | C | C | 155 | 167 | A |
| 1-6 | A | 52 | 4.3 | 100 | 205 | 156 | 153 | C | 1 | A | C | 172 | 167 | C |
| 1-7 | A | 19 | 5.0 | 0 | 371 | 153 | 153 | C | 1 | A | C | 167 | 167 | C |
| 1-8 | A | 5 | 24.2 | 0 | 319 | 160 | 153 | C | 2 | B | C | 190 | 167 | C |
| 1-9 | D | 36 | 7.8 | 69 | 267 | 157 | 158 | A | 2 | B | B | 166 | 172 | A |
| 1-10 | D | 38 | 6.0 | 52 | 263 | 154 | 158 | A | 2 | B | B | 165 | 172 | A |

In the results of Table 3, the balance microstructures was entirely composed of bainite except pearlite.

From the results in Table 3, it is possible to make the following observations. Test Nos. 1-1 to 1-4, 1-9 and 1-10 in Table 3 are examples which satisfy all the requirements specified in the embodiments of the present invention, and both the hardness and the spheroidization degree were good or excellent after SA1 in which the spheroidizing annealing time was shortened compared with conventional technology. In particular, unlike Test Nos. 1-3 to 1-4, 1-9 and 1-10, Test Nos. 1-1 to 1-2 are examples in which the carbon content is in a preferable range (less than 0.40% by mass) and the average cooling rate during the second cooling is in a preferable range (1 to 3° C./sec), thus satisfying preferable requirements (the area ratio of proeutectoid ferrite is more than 40%, and the area ratio of pearlite of the balance microstructures is less than 80%). Therefore, the spheroidization degree after SA1 became excellent, leading to excellent overall judgment.

Meanwhile, Test Nos. 1-5 to 1-8 in Table 3 are examples which do not satisfy the requirements specified in the embodiments of the present invention, and the hardness or spheroidization degree after SA1 was poor.

In Test No. 1-5, the average grain size of ferrite crystal grains became more than 15 μm because of high finishing temperature of 1,200° C., leading to poor spheroidization degree after SA1.

In Test No. 1-6, the average grain size of ferrite crystal grains became less than 5 μm because of low finishing temperature of 800° C., leading to poor hardness after SA1.

In Test No. 1-7, the area ratio of proeutectoid ferrite became less than 30% because of high average cooling rate of the second cooling of 10° C./sec, leading to poor hardness after SA1.

In Test No. 1-8, the finishing temperature is high temperature of 1,200° C., the area ratio of proeutectoid ferrite became less than 30%, and the average grain size of ferrite crystal grains became more than 15 μm, leading to poor hardness after SA1.

It has been found that softening is sufficiently achieved by satisfying all of the requirements specified in the embodiments of the present invention, like Tests Nos. 1-1 to 1-4, 1-9 and 1-10 in Table 3, even after SA2 in which spheroidization annealing was performed at a lower temperature than that of SA1, assuming a delay in temperature tracking.

Example 2

Using steels having the chemical compositions indicated by steel types B and C shown in Table 1, each steel was subjected to rolling and cooling in a mass production rolling line under the conditions shown in Table 4. In the rolling line, a heating furnace, a roughing rolling mill, an intermediate rolling mill, an intermediate water-cooling strip, a block mill rolling mill, a sizing mill rolling mill, a product water-cooling strip, a cooling conveyor and a high-rise warehouse are connected in this order. Pre-working is performed by the block mill rolling mill, and first cooling and second cooling were performed by the cooling conveyor. Although not shown in Table 4, cooling in the temperature range of 500° C. or lower was performed at the average cooling rate during second cooling to about 400° C., and then naturally cooled. Samples were cut out from the rolled material thus obtained, one of which was not subjected to spheroidizing annealing, and the other one was subjected to spheroidizing annealing.

The spheroidizing annealing was performed under the following two conditions (SA3 and SA4). Regarding SA3, the spheroidizing annealing time was shortened to about 9 hours, compared with about 15 hours in conventional technology. Regarding SA4, the spheroidizing annealing was performed at a lower temperature than that of SA3, assuming a delay in temperature tracking.

SA3: The test specimen was subjected to soaking by holding its temperature at 770° C. for 2 hours, then cooled to 685° C. at an average cooling rate of 13° C./hour, followed by allowed the test specimen to cool.

SA4: The test specimen was subjected to soaking by holding its temperature at 750° C. for 2 hours, then cooled to 660° C. at an average cooling rate of 13° C./hour, followed by allowed the test specimen to cool.

TABLE 4

| | | Working | | | | | Cooling | | | |
|---|---|---|---|---|---|---|---|---|---|---|
| | | Pre-working | | | Finishing | | First cooling | | | Second cooling |
| Test No. | Steel type | Temperature (° C.) | Compression ratio (%) | Holding time (sec) | Temperature (° C.) | Compression ratio (%) | Average cooling rate (° C./sec) | Cooling stop temperature (° C.) | Cooling time (sec) | Average cooling rate from cooling stop temperature to 500° C. (° C./sec) |
| 2-1 | B | 896 | ≥20 | ≤3 | 887 | ≥20 | 31 | 843 | 1.4 | 1.5 |
| 2-2 | C | 942 | ≥20 | ≤3 | 846 | ≥20 | 92 | 801 | 0.5 | 2.7 |

In the same manner as in Example 1, (1) the area ratio of proeutectoid ferrite, (2) the average grain size of ferrite crystal grains, (3) the ratio of area ratio of pearlite to total area ratio of microstructures other than proeutectoid ferrite, (4) the hardness before spheroidizing annealing, (5) the hardness after spheroidizing annealing and (6) the spheroidization degree were measured and evaluated. The case where the hardness after SA3 was rated Excellent (A) if it satisfies the above expression (2), while the hardness was rated Poor (C) if it does not satisfy the above expression (2). When the carbon equivalent is 0.70 or more, it is more preferable if the hardness after SA3 is HV150 or less. The case where the hardness after SA4 was rated Excellent (A) if it satisfies the above expression (3), while the hardness was rated Poor (C) if it does not satisfy the above expression (3). When the carbon equivalent is 0.70 or more, it is more preferable if the hardness after SA4 is HV165 or less.

The results are shown in Table 5.

TABLE 5

| | Before spheroidizing annealing | | | | After spheroidizing annealing | | | | | | | | |
|---|---|---|---|---|---|---|---|---|---|---|---|---|---|
| | | | | | After SA3 (high temperature) | | | | | | After SA4 (low temperature) | | |
| Test No. | Area ratio of proeutectoid ferrite (%) | Average grain size of ferrite crystal grains (μm) | Pearlite area ratio of balance microstructures (%) | Hardness (HV) | Hardness (HV) | Right side of expression (2) | Judgment | Spheroidization degree (No.) | Judgment | Overall judgment | Hardness (HV) | Right side of expression (3) | Judgment |
| 2-1 | 9 | 17.6 | 0 | 265 | 153 | 152 | C | 3 | C | C | 165 | 166 | A |
| 2-2 | 65 | 9.2 | 100 | 202 | 146 | 154 | A | 2 | B | B | 154 | 168 | A |

In the results of Table 5, the balance microstructures was entirely composed of bainite except pearlite.

From the results in Table 5, it is possible to make the following observations. Test No. 2-2 in Table 5 is an example which satisfy all the requirements specified in the embodiments of the present invention, and both the hardness and the spheroidization degree were excellent or good after SA3.

Meanwhile, in Test No. 2-1 in Table 5, the cooling stop temperature of the first cooling was higher than 840° C., the area ratio of proeutectoid ferrite was less than 30%, and the average grain size of ferrite crystal grains was more than 15 μm, leading to poor hardness and spheroidization degree after SA3.

INDUSTRIAL APPLICABILITY

The mechanical structure steel for cold-working according to the embodiment of the present invention is suitable for use in various components manufactured by cold-working such as cold forging, cold heading or cold rolling. The form of the steel is not limited particularly, but it can be, for example, a wire rod, or a rolled material such as a steel bar.

Examples of various components above specifically include automobile components and construction machine components, such as bolts, screws, nuts, sockets, ball joints, inner tubes, torsion bars, clutch cases, cages, housings, hubs, covers, cases, cradles, tappets, saddles, burgs, inner cases, clutches, sleeves, outer races, sprockets, stators, anvils, spiders, rocker arms, bodies, flanges, drums, joints, connectors, pulleys, metal fittings, yokes, mouthpieces, valve lifters, spark plugs, pinion gears, steering shafts, and common rails. The mechanical structure steel for cold-working according to the embodiment of the present invention is industrially useful as mechanical structural steels which are suitably used as materials for the above-mentioned components, and can exhibit low deformation resistance and excellent cold workability when manufactured into the above-mentioned various components at room temperature and in the work heating range after spheroidizing annealing.

The invention claimed is:

1. A mechanical structure steel, comprising:

C: 0.32 to 0.44% by mass,

Si: 0.15 to 0.35% by mass,

Mn: 0.55 to 0.95% by mass,

P: 0.030% by mass or less,

S: 0.030% by mass or less,

Cr: 0.85 to 1.25% by mass,

Mo: 0.15 to 0.35% by mass, and

Al: 0.01 to 0.1% by mass, with a balance being iron and inevitable impurities, wherein a microstructure of the mechanical structure steel includes proeutectoid ferrite and bainite, an area ratio of proeutectoid ferrite is greater than 35% and 70% or less, and an average grain size of ferrite crystal grains is 5 to 13.2 μm.

2. The mechanical structure steel of claim 1, wherein a ratio of an area ratio of pearlite to the total area ratio of microstructures other than the proeutectoid ferrite is 80% or less.

3. The mechanical structure steel of claim 1, having a hardness of HV300 or less.

4. The mechanical structure steel of claim 1, further comprising at least one of the following (a) to (c):

(a) one or more elements selected from the group consisting of Cu: greater than 0% to 0.25% by mass and Ni: greater than 0% to 0.25% by mass;

(b) one or more elements selected from the group consisting of Ti: greater than 0% to 0.2% by mass, Nb: greater than 0% to 0.2% by mass and V: greater than 0% to 1.5% by mass; and (c) one or more elements selected from the group consisting of N: greater than 0% to 0.01% by mass, Mg: greater than 0% to 0.02% by mass, Ca: greater than 0% to 0.05% by mass, Li: greater than 0% to 0.02% by mass and REM: greater than 0% to 0.05% by mass.

5. The mechanical structure steel of claim 1, further comprising greater than 0% to 0.25% by mass Cu; and greater than 0% to 0.25% by mass Ni.

6. The mechanical structure steel of claim 1, further comprising greater than 0% to 0.2% by mass Ti;

greater than 0% to 0.2% by mass Nb; and greater than 0% to 1.5% by mass V.

7. The mechanical structure steel of claim 1, further comprising greater than 0% to 0.01% by mass N;

greater than 0% to 0.02% by mass Mg; greater than 0% to 0.05% by mass Ca; greater than 0% to 0.02% by mass Li; and greater than 0% to 0.05% by mass REM.

8. The mechanical structure steel of claim 1, further comprising greater than 0% to 0.25% by mass Cu;

greater than 0% to 0.25% by mass Ni;

greater than 0% to 0.2% by mass Ti;

greater than 0% to 0.2% by mass Nb; and greater than 0% to 1.5% by mass V.

9. The mechanical structure steel of claim 1, further comprising greater than 0% to 0.25% by mass Cu;

greater than 0% to 0.25% by mass Ni;

greater than 0% to 0.2% by mass Ti;

greater than 0% to 0.2% by mass Nb;

greater than 0% to 1.5% by mass V;

greater than 0% to 0.01% by mass N;

greater than 0% to 0.02% by mass Mg; greater than 0% to 0.05% by mass Ca; greater than 0% to 0.02% by mass Li; and greater than 0% to 0.05% by mass REM.

* * * * *